US005908169A

United States Patent [19]

Brinkmeier

[11] Patent Number: 5,908,169

[45] Date of Patent: Jun. 1, 1999

[54] DEVICE FOR PROCESSING AT LEAST TWO WEBS OF MATERIAL MADE OF PAPER OR PLASTIC FILM

[75] Inventor: Friedhelm Brinkmeier, Lengerich, Germany

[73] Assignee: Windmoeller & Hoelscher, Lengerich/Westf., Germany

[21] Appl. No.: 09/017,500

[22] Filed: Feb. 2, 1998

[30] Foreign Application Priority Data

Feb. 5, 1997 [DE] Germany ..... 197 04 332

[51] Int. Cl.[6] ..... B65H 23/182

[52] U.S. Cl. ..... 242/422.8; 242/419.3; 242/419.4

[58] Field of Search ..... 242/419, 419.3, 242/419.4, 419.5, 421.8, 422.8

[56] References Cited

U.S. PATENT DOCUMENTS

| | | | |
|---|---|---|---|
| 2,008,618 | 7/1935 | Lefebvre | 242/422.8 |
| 3,863,858 | 2/1975 | Cauffiel et al. | 242/419.4 |
| 3,929,297 | 12/1975 | Zumfeld et al. | 242/419.4 |
| 5,706,868 | 1/1998 | Fritzson et al. | 242/419.4 |

FOREIGN PATENT DOCUMENTS

| | | | |
|---|---|---|---|
| 1445427 | 5/1966 | France | 242/422.8 |
| 1 196 060 | 7/1965 | Germany . | |
| 93 01 670 | 7/1993 | Germany . | |
| 1353711 A1 | 11/1987 | U.S.S.R. | 242/419.4 |

OTHER PUBLICATIONS

Bosenberg: Systematik der Bremssysteme Volumes Sheet Metal Tubes, 1975, Issue 1, pp. 12–16.

*Primary Examiner*—John P. Darling

*Attorney, Agent, or Firm*—Jacobson, Price, Holman & Stern, PLLC

[57] ABSTRACT

A device for processing at least two webs of material made of paper or plastic film is provided with at least two rolls of material, each of which can be rotated in an unwind unit and from each of which a predrawing unit, comprising predrawing rollers or rolls, takes off the web and pulls it into the device. To guarantee the proper infeeding of the web into the device, even if after a sudden operating stoppage the rolls of material coast longer than the predrawing units, there is between each unwind unit and each predrawing unit one brake each, which decelerates the web and which is activated when the predrawing units are abruptly stopped or they significantly delay the infeed.

14 Claims, 2 Drawing Sheets

Figure 1:
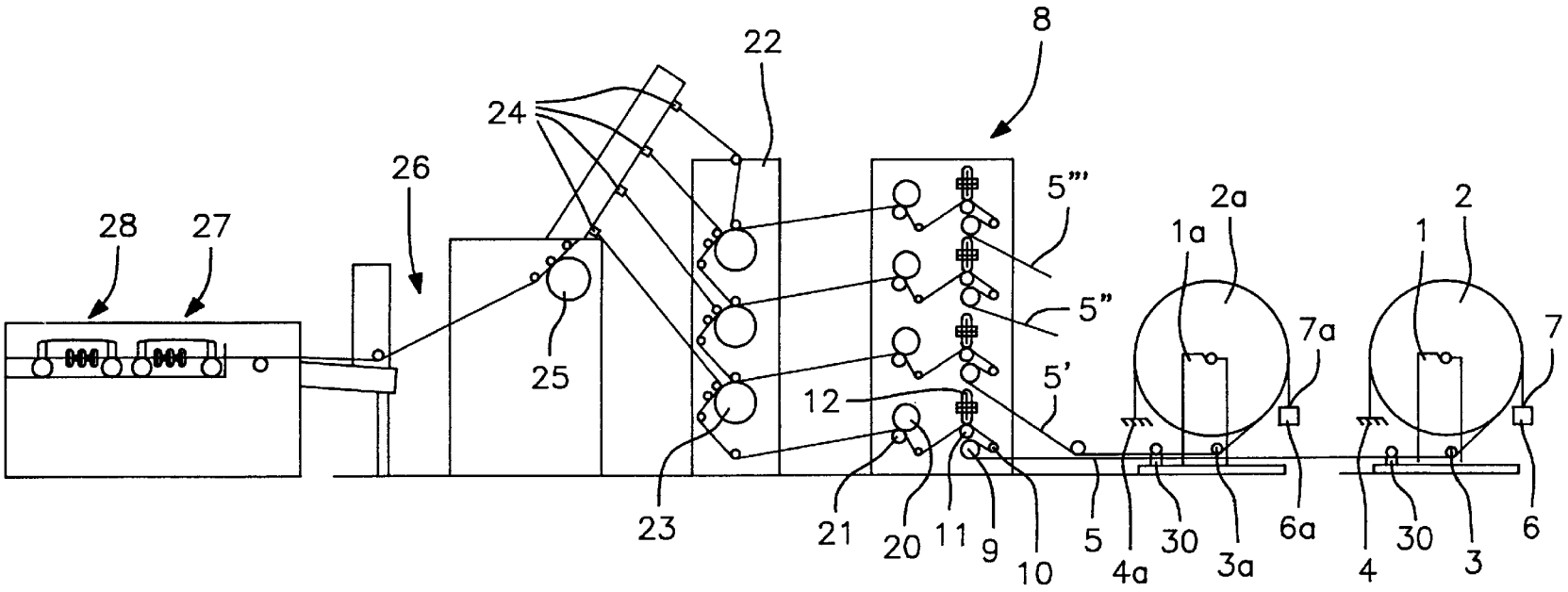

DEVICE FOR PROCESSING AT LEAST TWO WEBS OF MATERIAL MADE OF PAPER OR PLASTIC FILM

The invention relates to a device for processing at least two webs of material made of paper or plastic film, preferably for producing tube segments, with at least two rolls of material, each of which can be rotated in an unwind unit and from each of which a predrawing unit, comprising predrawing rollers or rolls, takes off the webs of material and pulls them into the device.

The rolls of material, storing the webs of material, usually exhibit a noticeable diameter and thus a significant weight, so that they have a high moment of inertia. Therefore, after a sudden stop of the predrawing unit, the rolls of material coast a relatively long period of time despite the band brakes, attacking the same, so that a loose, undulating segment of the web forms in front of the infeed device. The processing machine, at whose inlet the predrawing or infeed device is located, is not suddenly stopped even in the case of an emergency stop, but rather decelerated in a controlled manner with a relatively long delay. Nevertheless, the predrawing or infeed unit comes to a stand still in front of the roll of material. However, until this standstill the predrawing or infeed unit can still draw in a part of the loose and undulating segment of the web, a feature that automatically results in an undefined and also oblique infeeding and the formation of folds and waves, so that, when the processing unit starts up again, the result may be that the side may shift and the web may be at right angles, a state that then makes it necessary to remove the obliquely and undulatingly infeed segments of the web and to reintroduce the web.

Therefore, the object of the invention is to provide a device of the type that is described in the introductory part and where proper infeeding of the web into the device is guaranteed, even if after an operating stoppage the roll of material, from which the web of material is being taken off, coasts longer than the predrawing or infeed unit.

According to the invention, this problem associated with a device of the above described type is solved by arranging between each unwind unit and each predrawing unit one brake each, which decelerates each web separately and which is activated when the predrawing units are abruptly stopped or they significantly delay the infeed of the webs of material.

The device, according to the invention, ensures that each of the webs of material to be processed remains taut between the brake and the predrawing or infeed unit even in the case of a sudden stoppage of the device, so that after a renewed infeed via its predrawing and infeed unit the device pulls in taut web segments, which consequently cannot take the wrong course or run at right angles or form loops in the device.

Of course, it cannot be prevented that owing to the unavoidable coasting of the roll of material a loosely lying segment of the web piles up in front of each brake. However, this is harmless, since it cannot pass the brake in a loose state and thus form waves. Before the device starts up again, the roll of material can be turned back, so that the piling up of the loosely lying segment of the web is eliminated again, said piling up being in itself harmless.

A significant feature of the invention lies in the fact that each roll of material is assigned its own brake and that each brake is arranged as close as possible to the roll of material. Because if all webs, taken off the rolls of material, were assigned only one common brake, by means of which all webs were slowed down, the webs would be kept taut between the brake and the predrawing unit. However, it could not be prevented that the follow-up segments of the web would pile up in a completely uncontrolled manner in front of the brake and put themselves at right angles and form loops and run into each other, because the wind-up rolls are arranged in succession, and from said rolls the follow-up segments of the web enter together into the brake. Since, according to the invention, each roll of material is assigned its own brake, an undesired piling up and running into one another with the possibility of the webs of material forming folds and loops cannot occur.

Expediently each brake comprises a support system, which supports the web and forms the abutment and at which a cushion, which pushes the web against said support unit, can be employed.

Each support system can consist of a crossarm or a table. A preferred embodiment provides that each cushion comprises a brush roller, which can be pivoted around an axle or at a carrier, which can be lowered, or a roll with a flexible shell, for example foam rubber. Each roll can be pivoted on the carrier or the axle with a preset braking moment. Expediently each carrier or each axle is run with guides parallel to the abutment and can be employed with a pressure medium piston cylinder unit, for example a pneumatic cylinder, against said abutment.

One embodiment of the invention is explained in detail in the following with the aid of the drawings.

Figure 2:
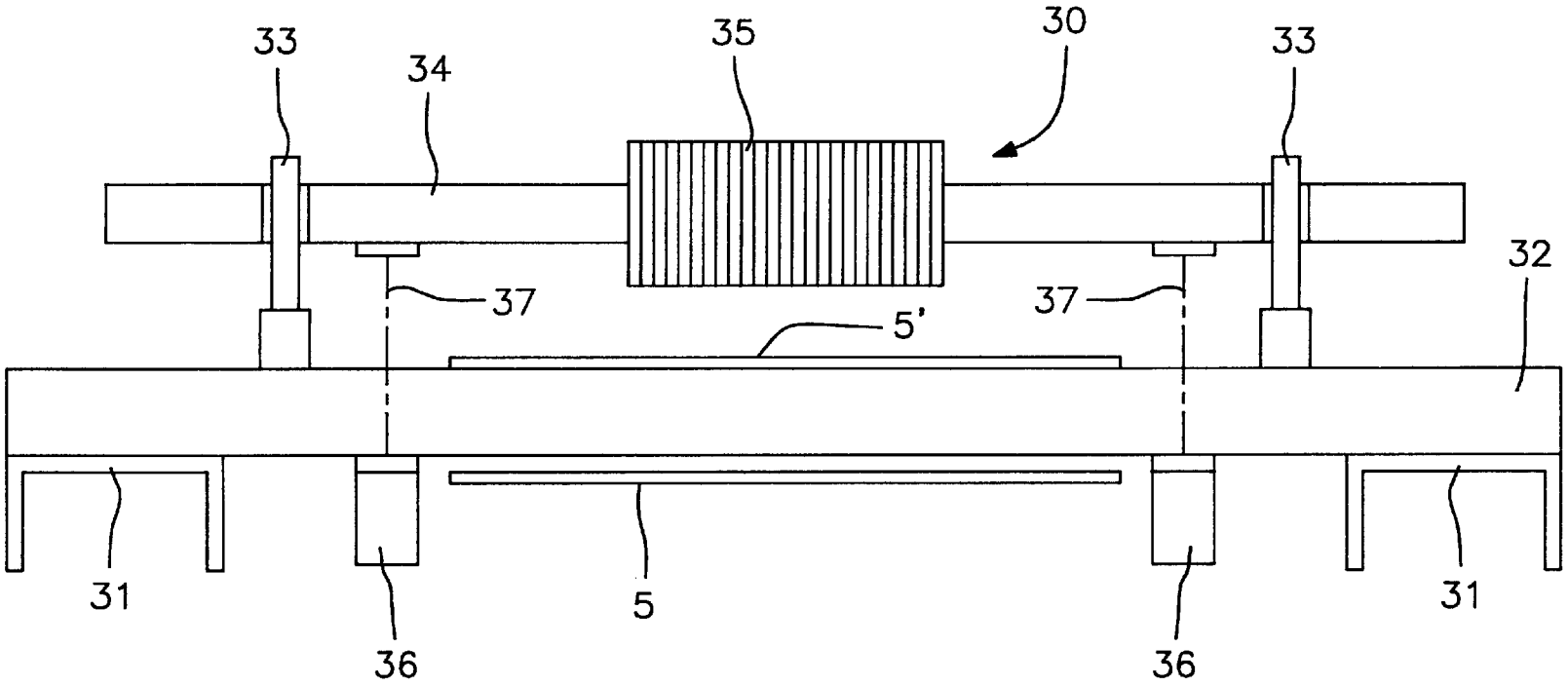

FIG. 1 is a schematic drawing of a side view of a system for producing multilayered tube segments made of paper and FIG. 2 is also a schematic drawing of a front view of a device decelerating a web.

FIG. 1 depicts a system for producing tube segments made of a four layered paper web, wherein the individual webs are taken off from rolls of materials, which are arranged in succession and mounted in unwind units and of which only two rolls of material 2, 2*a* are shown in FIG. 1. The rolls of paper 2, 2*a* are hung into a frame 1, 1*a* so as to rotate freely; and the drawn off webs 5, 5' run over guide rolls 3 and 3*a* to the infeed devices.

On the paper rolls 2, 2*a* are placed brake bands 7, 7*a*, which are loaded with weights 6, 6*a* and whose ends 4, 4*a* are attached rigidly to the frame in the manner shown and serve to decelerate the paper rolls 2, 2*a*. The unwind units are constructed in the customary manner and are, therefore, not described in detail.

The paper webs 5" and 5'" are taken off from paper rolls, which are not illustrated and are suspended in the same manner in the frames serving the purpose of unwinding.

The paper webs 5 to 5'" are fed by means of the predrawing units into the device, of which each predrawing roll comprises the driven predrawing roll 9 and the guide roll 10, which enlarges the looping angle. Behind the predrawing rolls 9, 10 there is a device, which provides the web with needle holes and which comprises a counterpressure roll 11, over which the infeed paper web runs and at which can be employed one of the needle rolls 12, which is mounted in a rotating revolver frame and provides the web with needle holes either over the web's entire width or in strips and serves to vent the sacks manufactured from the webs. Since the needle holes of the individual webs 5 to 5'" are not in alignment after the webs are brought together, labyrinthine venting channels are made through which the air, but not the product, can escape.

Mounting the needle rolls in a revolver serves the purpose of a fast replacement of the needle rolls, when their needles have become dull or when the regions of the paper webs to be pierced are to be changed.

After each paper web has been fed through the predrawing rolls 9, 10, arranged in the web's direction of flow in front of the needle roll, said web runs from the needle rolls to the cutting roll 20, which is employed at a counterpressure roll 21. The cutting roll provides the paper web with a cross perforation line, which forms the later tear line. From the cutting roll 20 the paper web 5, provided with needle holes and cross perforation lines, runs into a stand 22, in which the adhesive applicator rolls 23 apply adhesive strips, which run at right angles, on both sides of the perforation cuts of the webs 5, 5' and 5".

Then those paper webs, on which glue has been spread, are brought together in such a manner via the deflecting rollers 24, that the individual webs are moved laterally with respect to each other. Then the adhesive applicator disks 25 apply longitudinal coats of adhesive over the non-overlapped side regions of the paper webs. Finally in a tube forming station 26 the webs are folded in such a manner into a paper tube that: owing to the longitudinal adhesive strips each of the paper layers is cemented with itself into a tube so that the results of the paper webs are telescoped paper tubes.

Then the paper tube made in this manner runs in the customary manner into a predrawing machine 27, which pulls forth the paper tube and simultaneously holds it at the predrawing speed. This predrawing machine 27 is followed by a high speed revolving tear-off tool 28, which separates the perforation lines and thus tears individual tube segments from the length of tubing and said segments are then processed into bags. The predrawing machine 27 with tear-off tool 28 is also constructed in the customary manner and, therefore, does not need to be described in detail here.

The device described above is known from the DE-GM 296 00 461.8, to which reference is made for a more in depth presentation.

According to the invention, there is a brake 30, which shall be described in greater detail below with the aid of FIG. 2, between the predrawing units 9, 10 for each of the webs 5 to 5'" and between the rolls of material or the guide rollers 3, 3*a* of each unwind device.

A crossarm 32 is connected to U-shaped carriers 31, which can be the side members of the base frame of each unwind device. The upper side of this crossarm 32 forms a bearing and slide area for the web of material 5', taken off from the roll of material mounted in the related unwind unit.

The crossarm 32 is provided with side guides 33, where an axle 34 can be lowered and raised parallel to the crossarm 32. A brush roll 35 can be pivoted around the axle 34, where there is a brake (not illustrated), by way of which a braking moment can be adjusted, with which the brush roll 35 can be rotated relative to the axle 34.

To lift and lower the axle 34, pneumatic cylinders 36, whose piston rods 37 are hinged to the axle 34, are connected to the crossarm 32.

Furthermore, there is a controller (not illustrated), by means of which the pneumatic cylinders 36 are activated in the sense that they lower the axle 34 in the direction of the carrier 32, so that the brush roll 35 forces the web 5' against the surface of the crossarm 32 and retains the web 5' with a preset braking moment.

I claim:

1. Device for processing at least two webs of material made of paper or plastic film with at least two rolls of material, said device comprising an unwind unit for each of the webs of material, a predrawing unit, comprising predrawing rolls or rollers, taking off the webs of material from the unwind units and pulling the webs of material, and a brake unit, which brakes separately the webs, between each unwind unit and each predrawing unit, each brake unit including a bearing and sliding surface for the web of material pulled from the roll of material mounted in a related unwind unit, and an axle carrier extending over the entire width of the bearing and sliding surface and being provided with a cushion, each axle carrier extending parallel to the bearing and sliding surface and being guided in guides and being movable into engagement against said bearing and sliding surface by pressure medium piston-cylinder units to contact the web of material and force the web of material against the bearing and sliding surface so as to retain the web of material with a preset braking movement.

2. Device for processing at least two webs of material as claimed in claim 1, wherein said cushion is a brake roll.

3. Device for processing at least two webs of material as claimed in claim 2, wherein said bearing and sliding surface is part of a crossarm, said piston-cylinder units extending from said crossarm to said axle carrier.

4. Device for processing at least two webs of material as claimed in claim 3, wherein said guides extend between said crossarm and said axle carrier.

5. Device for processing at least two webs of material as claimed in claim 1, wherein each brake unit is activated when the predrawing units are abruptly stopped.

6. Device for processing at least two webs of material as claimed in claim 1, wherein the piston-cylinder units are pneumatically operated.

7. A system for simultaneously processing at least two webs of material simultaneously originating from at least two rolls of said material, said system comprising:

an unwind unit for guiding unrolling of each of said at least two webs of material from said at least two rolls, a predrawing unit for drawing each of said at least two webs of material from a respective unwind unit, a brake unit located between each said unwind unit and each said predrawing unit, each said brake unit including a support structure including a bearing and sliding surface, an axle spaced from and extending parallel to said bearing and sliding surface, said axle having a brake roll for movement towards and away from said bearing and sliding surface upon pivotal movement of said axle to contact a web of material and force the web of material into engagement with said bearing and sliding surface, each said brake unit cooperating in unison to retain each of said at least two webs of material with a preset braking moment upon an abrupt stoppage of said predrawing unit.

8. A system as claimed in claim 7, wherein said support structure is a crossarm.

9. A system as claimed in claim 8, wherein two guides extend between said crossarm and said axle.

10. A system as claimed in claim 8, wherein the crossarm is mounted on each unwind unit.

11. A system as claimed in claim 10, wherein U-shaped carriers mount the crossarm on each unwind unit.

12. A system as claimed in claim 7, wherein piston-cylinder units move said axle in pivotal movement towards and away from said bearing and sliding surface.

13. A system as claimed in claim 12, wherein the piston-cylinder units are pneumatically operated.

14. A system as claimed in claim 7, wherein said brake roll is rotatably mounted on said axle.

* * * * *